US006607089B2

(12) United States Patent
Ferguson

(10) Patent No.: US 6,607,089 B2
(45) Date of Patent: Aug. 19, 2003

(54) FLAT COLLAPSIBLE COVER FOR A PRODUCE CONTAINER

(75) Inventor: Roy G. Ferguson, Mississauga (CA)

(73) Assignee: Chantler Packaging, Inc (CA)

( * ) Notice: Subject to any disclaimer, the term of this patent is extended or adjusted under 35 U.S.C. 154(b) by 0 days.

(21) Appl. No.: 09/891,977

(22) Filed: Jun. 26, 2001

(65) Prior Publication Data

US 2002/0195450 A1 Dec. 26, 2002

(51) Int. Cl.[7] ..... B65D 43/08; B65D 5/00

(52) U.S. Cl. ..... 220/367.1; 229/125.19; 229/125.29; 229/125.32; 229/120

(58) Field of Search ..... 229/125.19, 125.29, 229/125.36, 125.32, 125.28, 120; 206/512; 220/367.1

(56) References Cited

U.S. PATENT DOCUMENTS 2,163,017 A * 6/1939 Berch ..... 229/125.28
2,239,571 A * 4/1941 Ray ..... 229/125.28
2,319,924 A * 5/1943 Ferguson ..... 229/125.19 X
2,944,725 A * 7/1960 Hayes ..... 229/125.36
3,412,893 A * 11/1968 Slapnik ..... 206/512
4,053,100 A * 10/1977 Baptist ..... 229/125.26
4,089,417 A * 5/1978 Osborne ..... 229/125.29
4,279,374 A * 7/1981 Webinger ..... 229/120
4,530,440 A * 7/1985 Leong ..... 229/120
5,060,851 A * 10/1991 Lorenz ..... 229/125.29
5,114,766 A * 5/1992 Jacques ..... 229/120
5,390,847 A * 2/1995 Young ..... 229/125.29

* cited by examiner

*Primary Examiner*—Tri M. Mai
(74) *Attorney, Agent, or Firm*—Robert F. I. Conte; Barnes & Thornburg

(57) ABSTRACT

A plastic cover for a produce container which when laid out is flat. The cover is collapsible and has a plurality of ventilators. Each ventilator has a ventilator flap and a corresponding ventilator aperture. The cover has a plurality of container binding members. Each container binding member has a container flap. Each container flap has a first small flap and a second small flap. Each container flap has a corresponding container receiving aperture. Each container binding member receives a portion of the container to assist in binding the cover to the container.

3 Claims, 3 Drawing Sheets

FLAT COLLAPSIBLE COVER FOR A PRODUCE CONTAINER

FIELD OF INVENTION

This invention concerns a flat plastic collapsible cover designed to fit over produce containers.

BACKGROUND OF PRIOR ART

A produce shipper often uses a reusable container to ship produce. The shipper will fill the container, often reusable, with produce. To better protect the produce from the elements and from drying out a plastic film type cover is often used.

SUMMARY OF THE INVENTION

It is an object of the present invention to design a plastic flat collapsible cover that attaches to produce containers more snuggly than previous containers. It is also a further object of the invention to improve the venting system in the cover. It is also an object of the invention to provide a material which better reflects the suns heat. Accordingly, a cover is provided that is a flat plastic collapsible container for produce. The cover has a plurality of ventilators. Each ventilator has a ventilator flap and corresponding ventilator aperture. Each ventilator is formed from a portion of said cover.

The cover also has a plurality of container binding members. Each container binding member has a container flap. Each container flap has a first and second flap edge. The first and second flap edges are perpendicular to each other and joined by a beveled corner. Each flap has a first small flap and a second small flap. The first and second small flaps are formed from said cover and integral with a corresponding container flap.

Each container flap has a corresponding container receiving aperture. Each corresponding aperture has a perimeter which corresponds to an outer perimeter defined by said corresponding flap. Each container binding member is formed from a container flap and a corresponding aperture. Each container binding member is formed from said cover.

DETAILED DESCRIPTION OF THE INVENTION

The present invention will be described fully hereinafter with reference to the accompanying drawings, in which a particular embodiment is shown, it is understood at the outset that a person skilled in the art may modify the invention herein described while still achieving the desired result of this invention. Accordingly, the description which follows, is to be understood as a broad, informative disclosure directed to persons skilled in the appropriate arts and not as limitations of the present invention.

Figure 1:
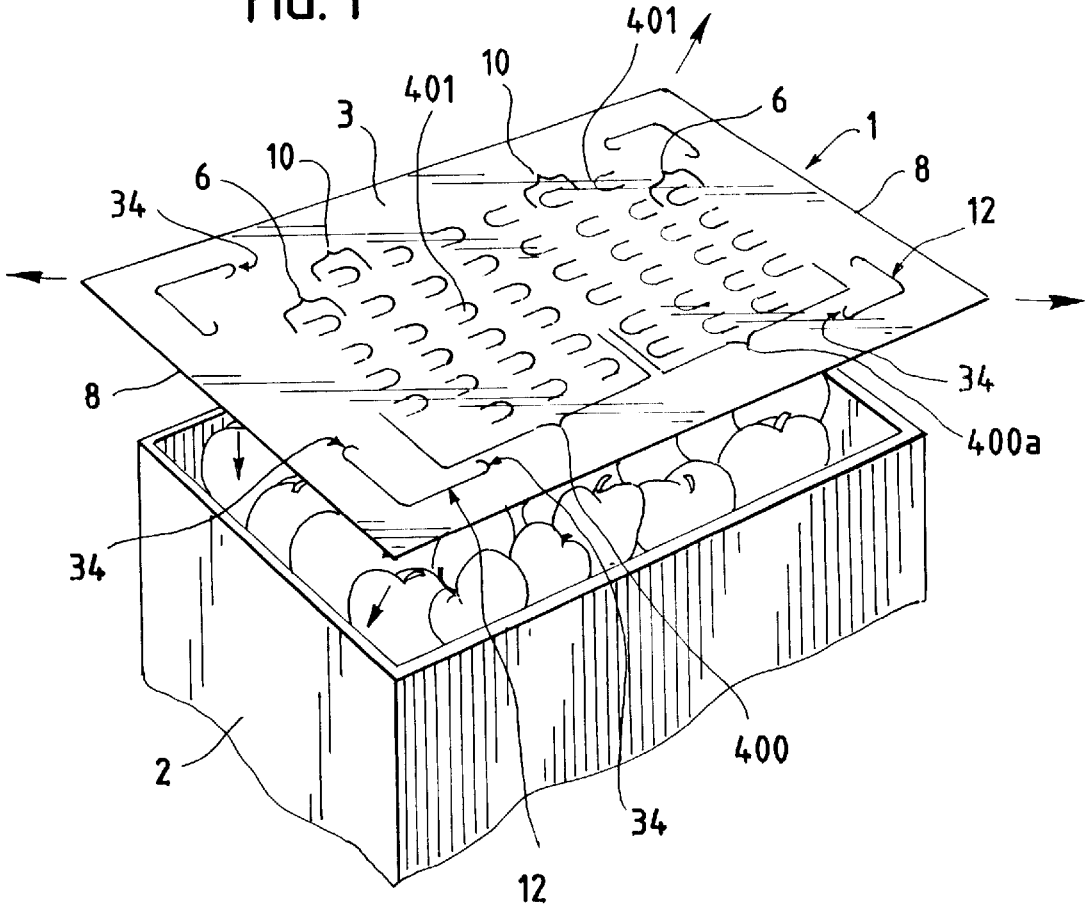
FIG. 1 is a top perspective view of the cover shown in relation to a produce container with the produce already inside.
Figure 2:
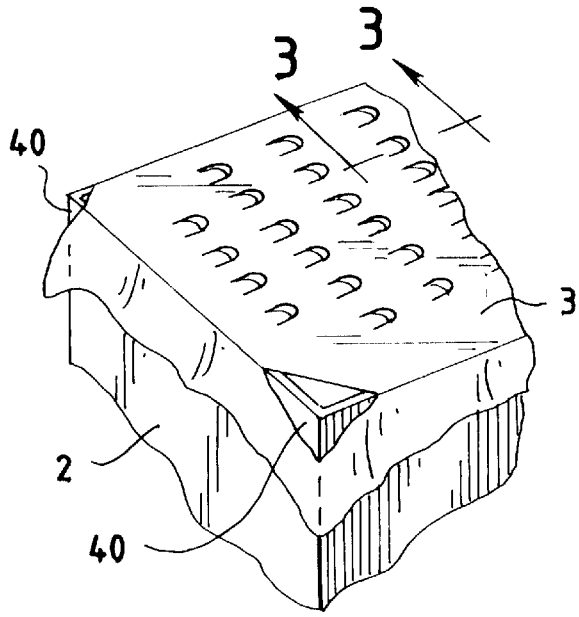
FIG. 2 is a top perspective view of the cover fitted on top of the produce container.
Figure 3:
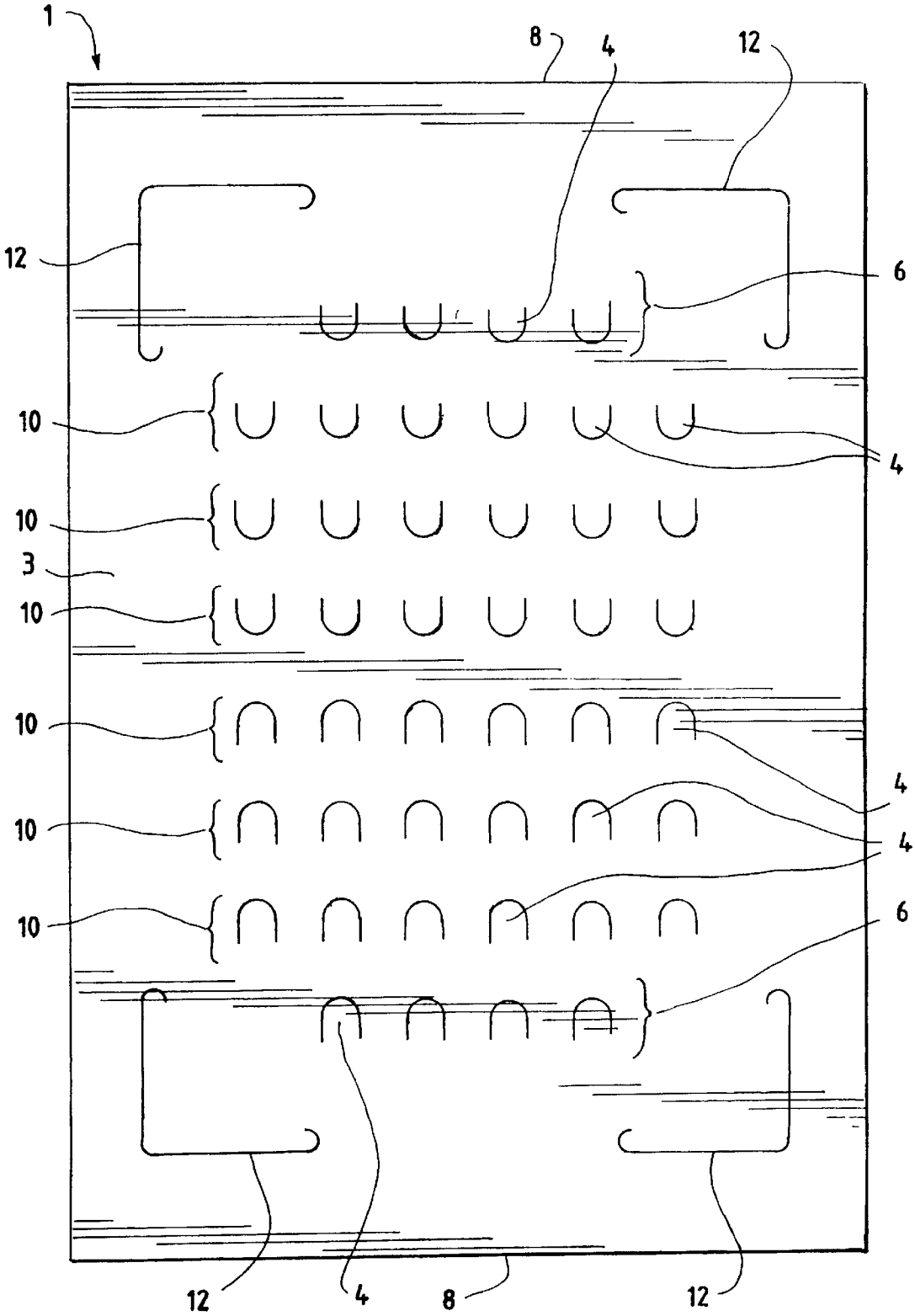
FIG. 3 is a top view of the cover.

The cover 1 of the invention can be seen in FIG. 3. The cover 1 is made of a composite polymer that allows the cover to be stretched so that it fits over the top opening of container 2. The cover 1 is preferably white in color so that it can reflect the sun's heat away from the produce. The cover 1 is shown as a rectangle but can be produced in different shapes to conform with the opening of various containers.

The surface 3 of cover 1 contains a plurality of ventilators 4. The ventilators 4 operate to allow air to enter the container, while at the same time protecting the produce. The ventilators shown have a particular arrangement. There are 2 exterior lateral ventilator rows 6. These lateral rows are closest to lateral cover edges 8. Each lateral row 6 has four ventilators. The cover has interior lateral ventilator rows 10. There are six laterally extending interior rows 10. Each laterally extending interior row has six ventilators.

There is a first group of ventilators 400, each ventilator in the first group has its arcuate u-shape portion 401 facing a first direction toward a lateral cover edge 8. The first group of ventilators 400 is made up of three of the interior lateral ventilator rows 10 and one of the exterior lateral ventilator rows 6. A second group of ventilators 400*a* each have their arcuate u-shape portion 401 facing in a direction opposite the first group of ventilators and towards a lateral edge 8 opposite the lateral edge towards which the first group of ventilators face. The second group of ventilators also consists of three interior lateral ventilator rows 10 and one exterior lateral ventilator row 6.

Figure 4:
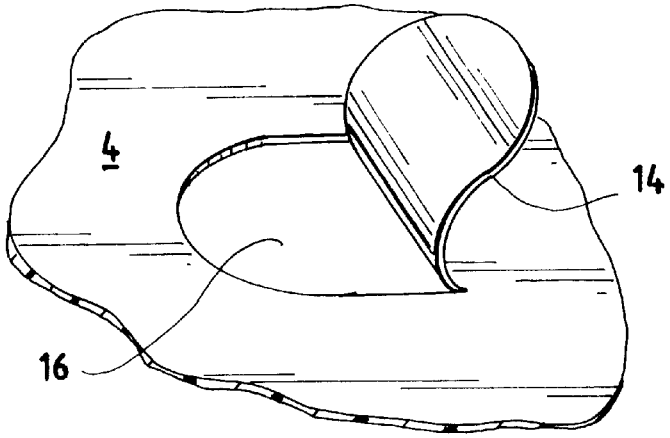
FIG. 4 is a close up perspective view of a ventilator showing the ventilator flap in the upwards position away from the ventilator opening.

FIG. 4 shows a blow up of a ventilator 4. Each ventilator is identical. As shown in FIG. 4, each ventilator consists of a ventilation flap 14 and a ventilation aperture 16. The ventilation flaps 14 are u-shaped. Each ventilation flap has a corresponding u-shaped ventilation aperture 16.

Figure 5:
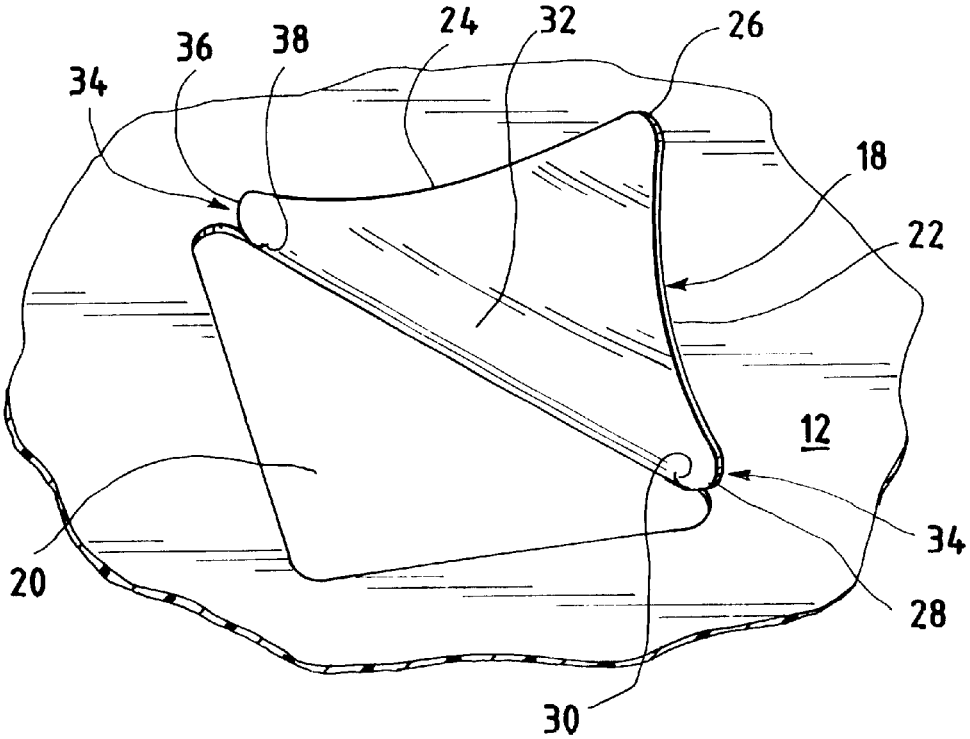
FIG. 5 is close up perspective view of a container binding member having a container receiving aperture and a corresponding container flap upwardly away from the container receiving aperture.

At each corner of cover 1, there is a container binding member or portion 12. There are 4 container binding portions. FIG. 5 shows a blow up of a container binding portion 12. Each portion 12 is identical. As can be seen by FIG. 5, each container binding portion 12 has a container flap 18. Each flap 18 is bounded by a first flap edge 22 and a second flap edge 24. These flap edges are perpendicular. An arcuate flap edge 26 joins flap edge 22 and 24. The arcuate edge 26 thus forms a beveled flap corner.

An arcuate edge 28 extends from a first end of said flap edge 22. The arcuate edge 28 forms a portion of a first slit 30. The first slit 30 extends into flap 18. The arcuate edge 28 and first slit 30 form a portion of small unshaped flap 34 which is integral with container flap 18.

An arcuate edge 36 extends from a first end of said second flap edge 24. The arcuate edge 36 forms a portion of a second slit 38. The second slit 38 also extends into said flap 18. The arcuate edge 36 and first slit 30 form a portion of another small unshaped flap 34 which is integral with container flap 18.

Each flap 18 has a corresponding container receiving aperture 20. Each container receiving aperture receives a corner 40 of said container. Each container receiving aperture and corresponding container flap form a container binding member 12. Each binding member 12 serves to couple the cover to the container and protect the containers contents.

The cover is made of a composite polymer. The composite polymer is made of LLDPE or LDPE or HDPE or CPP or DOPP or PET or any combination of Polymers and paper.

I claim:

1. A flat plastic collapsible cover for a produce container comprising:

a plurality of ventilators each ventilator has a ventilator flap and a corresponding ventilator aperture, each ventilator flap and aperture being formed from a portion of said cover;

a plurality of container binding members, each container binding member having a container flap formed at a spaced apart distance from a perimeter of said cover, said container flap being formed from said cover;

each container flap having a first flap edge and a second flap edge, said first and second flap edges being perpendicular to each other and being joined by a beveled corner, each flap having a first small flap and a second small flap, said first small flap at a first end of said first flap edge, said second small flap at a first end of said second flap edge, said first and second small flaps formed from said cover and integral with said container flap;

a plurality of container receiving apertures each of said apertures being formed by a corresponding slit defining each of said container flaps.

2. The cover as claimed in claim 1 wherein the cover is white.

3. The cover as claimed in claim 1 wherein the cover is a plastic stretchable film.

* * * * *